US005709432A

United States Patent [19]

Gryp

[11] Patent Number: 5,709,432

[45] Date of Patent: Jan. 20, 1998

[54] ADJUSTABLE ARMREST APPARATUS

[75] Inventor: Dennis J. Gryp, East Moline, Ill.

[73] Assignee: Sears Manufacturing Company, Davenport, Iowa

[21] Appl. No.: 613,416

[22] Filed: Mar. 11, 1996

[51] Int. Cl.[6] ..... A47C 7/54

[52] U.S. Cl. ..... 297/411.32; 297/411.38

[58] Field of Search ..... 297/411.32, 411.38, 297/411.2, 411.3, 411.35

[56] References Cited

U.S. PATENT DOCUMENTS

| | | | |
|---|---|---|---|
| Re. 19,721 | 10/1935 | Genung . | |
| 3,544,163 | 12/1970 | Krein . | |
| 3,612,606 | 10/1971 | Swenson . | |
| 3,807,799 | 4/1974 | Freedman . | |
| 3,967,851 | 7/1976 | Stier . | |
| 3,993,350 | 11/1976 | McFarlane | 297/411.38 |
| 4,067,613 | 1/1978 | Peruri | 297/411.32 X |
| 4,159,145 | 6/1979 | Quakenbush . | |
| 4,219,235 | 8/1980 | Heling . | |
| 4,244,623 | 1/1981 | Hall et al. . | |
| 4,807,935 | 2/1989 | King . | |
| 4,848,840 | 7/1989 | Toya . | |
| 4,969,686 | 11/1990 | Germain . | |
| 5,056,868 | 10/1991 | Beck | 297/411.38 X |
| 5,106,160 | 4/1992 | Nomura et al. . | |
| 5,188,423 | 2/1993 | Mueller et al. | 297/411.38 |
| 5,316,373 | 5/1994 | Markel | 2987/411.32 |

*Primary Examiner*—Peter R. Brown

*Attorney, Agent, or Firm*—Niro, Scavone, Haller & Niro

[57] ABSTRACT

An adjustable armrest assembly for a seat including a shaft mounted to and extending laterally from the seat and having a stop member, and an armrest frame rotatably mounted on the shaft including first and second stop members positioned to permit limited rotation of the frame on the shaft where one of the stop members is adjustable to adjust the degree of rotation of the frame about the shaft.

10 Claims, 3 Drawing Sheets

ADJUSTABLE ARMREST APPARATUS

BACKGROUND OF THE INVENTION

The present invention relates to an armrest assembly and, more specifically, to an adjustable armrest for use with vehicle seats.

Seats with armrests are well known in the art. Vehicle seats with armrests provide desired comfort for long trips. Additionally, adjustable armrests allow convenient entry and exit from the vehicle seat, and provide additional comfort by allowing the seat occupant to adjust his or her posture as desired.

Currently utilized adjustable armrests vary considerably. Most are believed to be designed to be secured in one form or another to a seat frame and to be used with an upholstered seat.

Fabrication and assembly of such armrests can be timely, complicated and costly. Furthermore, many adjustable armrests are not interchangeable between the left and right sides of a seat. This lack of interchangeability can also add to the cost of assembly, manufacture and inventory of armrests.

The present invention solves the problems associated with these prior art armrests while preserving their attendant benefits. The present invention provides an adjustable armrest structure which allows greatly simplified manufacture, assembly and use without the disadvantages of the prior art.

SUMMARY OF THE INVENTION

In accordance with the present invention, an adjustable arm rest assembly is provided having a shaft that extends laterally from the seat, a stop member located in a fixed position on the shaft, an armrest frame rotatably mounted on the shaft and having first and second stop engaging members positioned to permit limited rotation of the armrest frame on the shaft. At least one of the stop engaging members may be adjusted to change the degree of rotation of the armrest frame on the shaft.

The primary object of the present invention is to provide an adjustable armrest which is simple in construction and easy to assemble to a seat.

Another object of the present invention is to provide an adjustable armrest which can be interchangeably mounted to either side of a seat.

Art even further object of the present invention is to provide a simplified adjustable armrest structure which utilizes standard assembly connectors for inexpensive manufacture.

DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
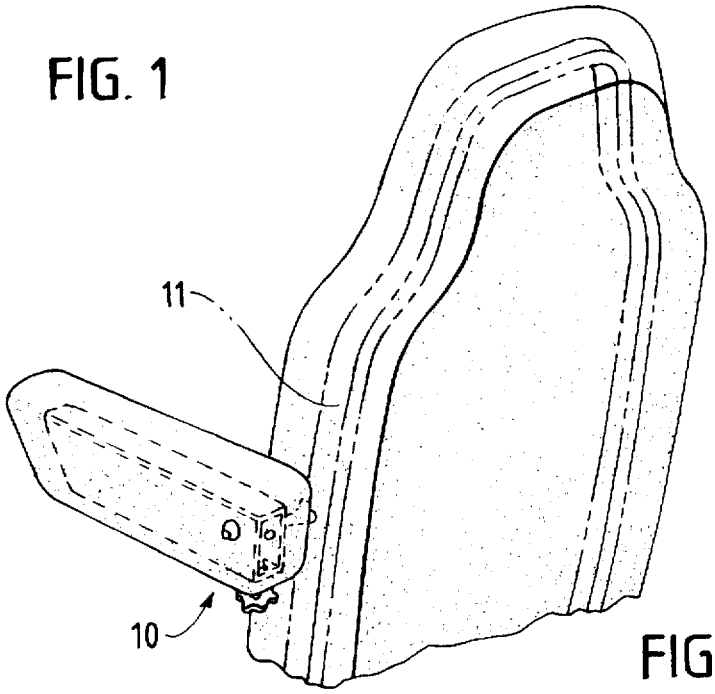
FIG. 1 is a perspective view of the adjustable armrest of the present invention as used in an upholstered seat.
Figure 4:
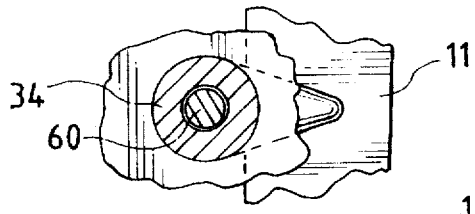
FIG. 4 is a partial cross-sectional view of the present invention taken along the line 4—4 of FIG. 3.
Figure 2:
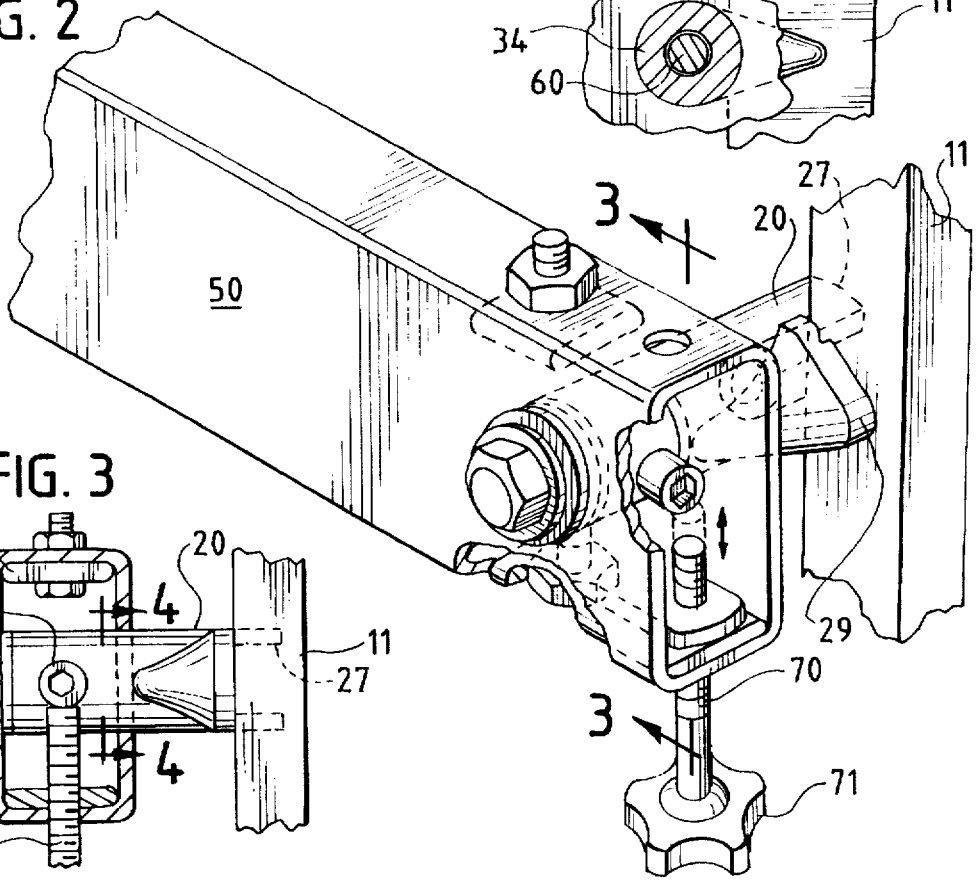
FIG. 2 is a perspective, partial cutaway view of the adjustable armrest of the present invention.
Figure 3:
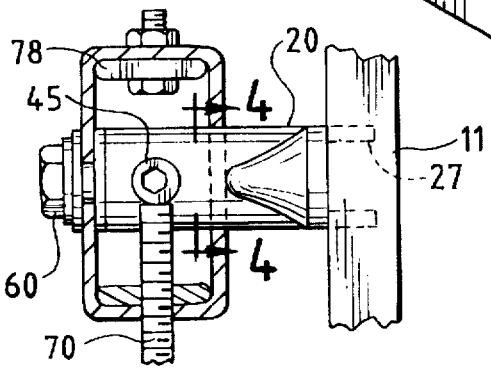
FIG. 3 is a cross-sectional view of the adjustable armrest of the present invention taken along line 3—3 of FIG. 2.
Figure 5:
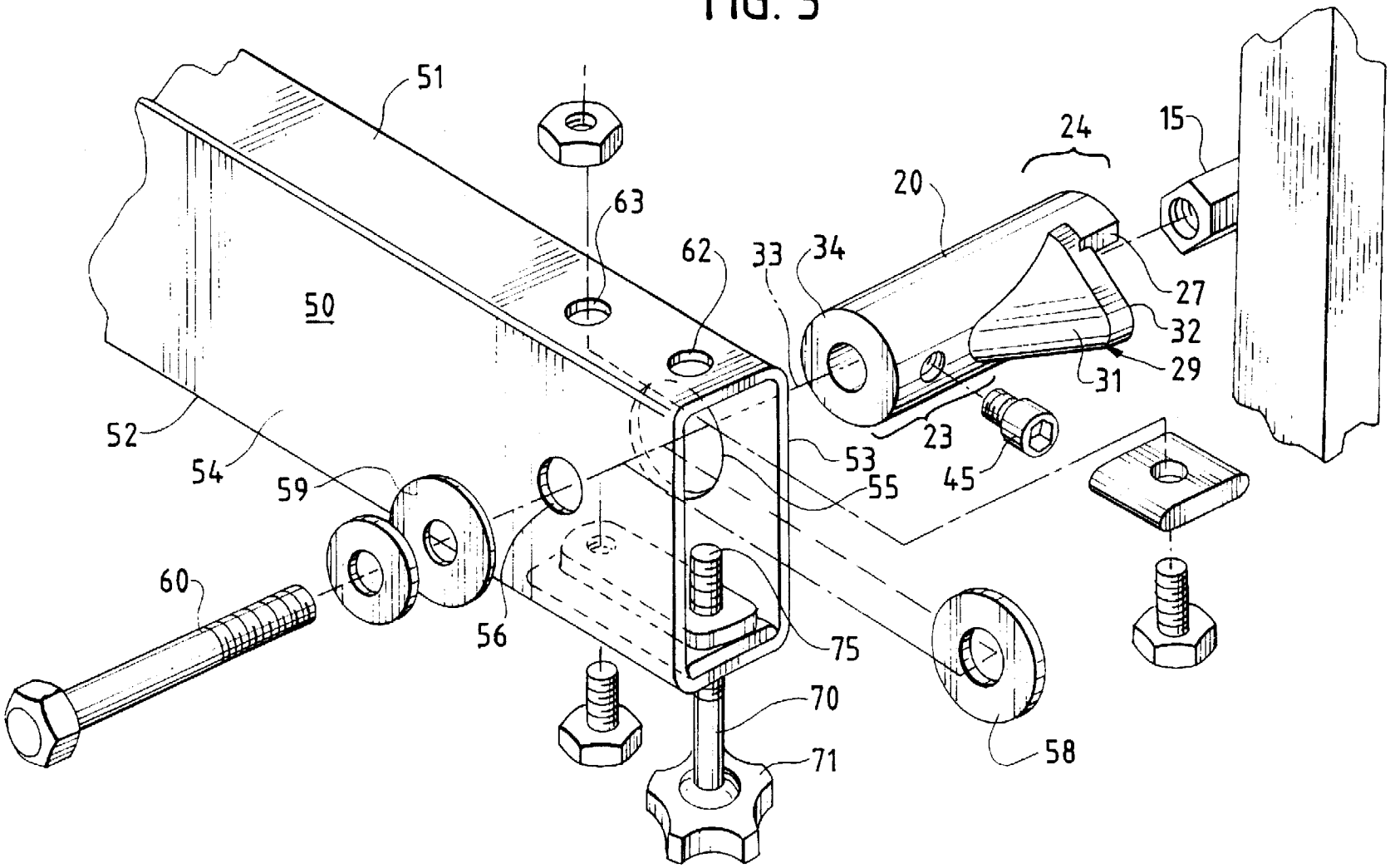
FIG. 5 is an exploded view of the adjustable armrest of present invention.

As seen in FIGS. 1, 2 and 5, and as designated generally 10, an adjustable armrest is provided to be mounted to a seat frame 11. Seat frame member 11 is shown in a generally vertical position. A conventional internally threaded fastener or nut 15 is welded or otherwise fixedly secured to frame 11. A pivot bar or shaft 20 is designed to extend coaxially over nut 15. Shaft 20 has a distal portion 23 which communicates with armrest frame 50, and base portion 24 which communicates with frame 11. The distal portion 23 is substantially cylindrical while the base portion 24 includes an axially extending flat or planar surface 27 that faces against frame 11. Extending from shaft 20 is radially extending flange 29 having sloped surface 31 and face 32 abutting frame 11. A stop 45 is threaded into the distal portion 23 of shaft 20. In the preferred embodiment the stop is a radially protruding threaded pin.

In operation, shaft 20 coaxially houses nut 15. Planar surfaces 27 abut frame 11 and thus stabilize hub 20 against frame 11. Face 32 of flange 29 also abuts frame 11 thereby positioning the shaft relative to the frame. Face 32 also provides a reinforcing structure to resist radial forces exerted upon shaft 20 when, for example, an occupant of the seat leans down on the armrest.

Armrest frame 50 may be a channel or tubular construction having top 51, bottom 52, and sides 53 and 54. The inner side 53 of armrest frame 50 has an aperture 55 for receiving shaft 20 and the outer side 54 has smaller aperture 56, each sharing a common center point. Larger aperture 55 of armrest frame 50 is sized to receive shaft 20 such that pin 45 is located substantially along the center line of the armrest frame 50. A polypropylene washer 58 is disposed between annular planar surface 34 of shaft 20 and sidewall 54. A bolt 60 extends through a second polypropylene washer 59, smaller aperture 56, washer 58, shaft 20, and threadedly engages nut 15. Bolt 60 thus secures the armrest assembly to frame 11 and defines an axis of rotation 33 of armrest 50. Polypropylene washers 58 and 59 reduce friction between inner sidewall 54 of armrest frame 50 and planar surface 34 of shaft 20. By this attachment means, armrest frame 50 is free to rotate around shaft 20.

Figure 8:
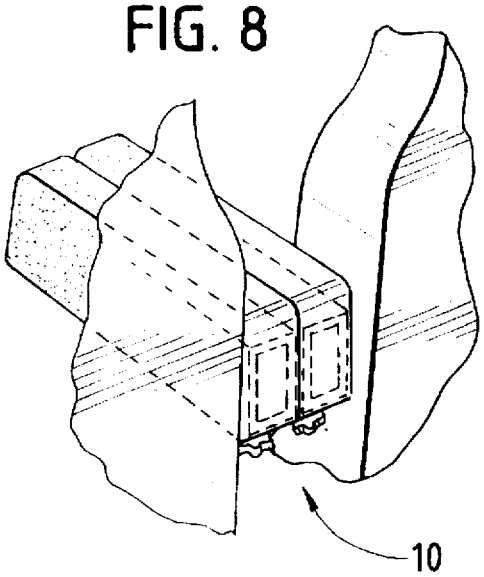
FIG. 8 is a perspective view of adjustable armrests of the present invention mounted side-by-side on the left and right hand sides of adjacent seats.

The top wall 51 of armrest frame 50 contains two holes 62 and 63. Holes 62 and 63 are mirror images to two holes (not shown) on the opposing bottom wall 52. As will be seen, if the armrest frame is mounted on the left side of seat frame 11, as shown in FIG. 5, holes 62, 63 reside in top wall 51 of frame 50. When armrest frame 50 is mounted on the right side of seat frame 11, as seen in FIG. 8, the opposing holes will be on the top of armrest frame 50. Reference is made herein to armrest frame 50 mounted on the left side of seat frame 11. The description is identical for the armrest mounted on the right side.

Figure 6:
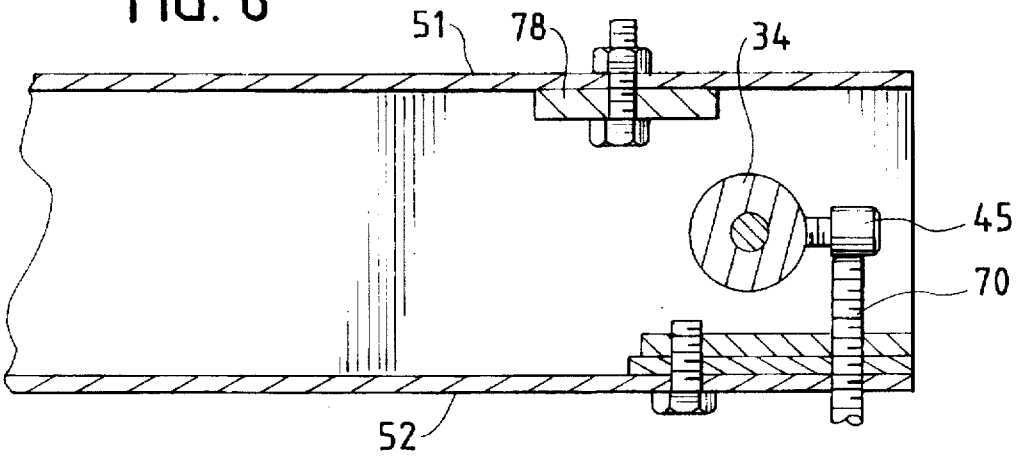
FIG. 6 is a partial cross-sectional view of the adjustable armrest of the present invention in the horizontal position.

Rotatably disposed within the bottom wall 52 is a threaded stop engaging member 70 terminating at its lower end at knob 71. The upper end of member 70 defines a surface which forms abutment 75. Abutment 75 works to restrict downward rotation of armrest 50 by stop 45 contacting abutment 75 as illustrated in FIG. 6.

Figure 7:
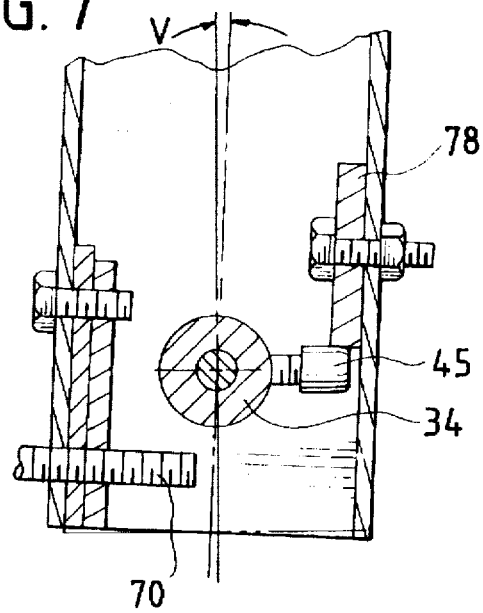
FIG. 7 is a partial cross-sectional view of the adjustable armrest of the present invention in a rotated position.

Disposed within upper hole 63 is an upper stop engaging member 78 positioned against the underside of the upper wall 51 of armrest frame 50. Member 78 is preferably made of polypropylene. Upper abutment member 78 restricts upward rotation of armrest frame 50 when armrest frame 50 reaches its intended uppermost position, as seen in FIG. 7.

As explained, armrest frame 50 is rotatably secured to seat frame 11. In normal operation, armrest 50 will have an operating position which, for purposes of this invention, is that generally horizontal position at which a seat occupant has use of the structure as an armrest. Armrest 50 also has a rotated position which, as defined herein, is a generally vertical position. As armrest frame 50 rotates, shaft 20 and stop 45 remain in fixed position relative to frame 11, while the stop engaging members 70 and 78 rotate with frame 50 until one or the other abuts stop 45.

Stop engaging member 70 is threadedly disposed in frame 50. As such, rotating knob 71 causes abutment surface 75 to move relative to stop 45. Thus, actuation of knob 71 to raise or lower surface 75 causes the operating position of the armrest frame 50 to move upward or downward.

As will be appreciated, the present invention facilitates assembly of an adjustable armrest utilizing a wide range of sizes of armrest frame 50. If the height of armrest frame 50 increases, stop 45 need only be adjusted outward by unscrewing pin 45 from shaft 70 so that stop 45 remains within the rotational path of members 70 and 78. Conversely, if the height of armrest frame 50 decreases, stop pin 45 need only be adjusted inwardly by screwing pin 45 further into shaft 20.

Additionally, in a preferred embodiment, both seat frame 11 and armrest frame 50 are cushioned and upholstered. When an upholstered armrest frame 50 is assembled to an upholstered seat frame 11, the cushioning of each is slightly compressed against the other. This compression provides a frictional inertia such that armrest frame 50 will not freely rotate, or bounce. As is readily apparent, the length of hub 20 can be appropriately altered for various sizes of seat frames and armrest structures and respective cushioning dimensions to provide the appropriate cushion compression and rotational coupling.

Furthermore, the armrest structure of the present invention facilitates greatly simplified assembly. In manufacture, nut 15 is welded to seat frame 11. Seat frame 11 is then cushioned and upholstered. Simultaneously, armrest frame 50 is forged, cushioned and upholstered. To assemble armrest frame 50 to seat frame 11, a manufacturer, dealer or consumer need only slit the upholstery and cushion of seat frame 11 adjacent coupling nut 15 and the cushion and upholstery adjacent apertures 55, 56, 62 and 63 of armrest 50, slide hub 20 onto coupling nut 15, and slide pivot pin 60 into and through armrest frame 50, hub 20, and coupling nut 15. Moreover, removal and replacement of the armrest from the seat is equally simple. And because the adjustable armrest apparatus is interchangeable from the left to the right side of a seat, assembly is further simplified and inexpensive because no additional tools or procedures are needed from one side to the other.

Of course, it should be understood that various changes and modifications to the preferred embodiments described herein will be apparent to those skilled in the art. Other changes and modifications, such as those expressed here or others left unexpressed but apparent to those of ordinary skill in the art, can be made without departing from the spirit and scope of the present invention and without diminishing its attendant advantages. It is, therefore, intended that such changes and modifications be covered by the following claims.

What is claimed is:

1. An adjustable armrest assembly mounted to a seat having a frame, comprising:

a shaft having two ends mounted to and extending laterally from said seat frame, said shaft including at least one stop member and one end of the said shaft having a radially extending surface and an axially extending surface abutting the seat frame to resist radially directed forces applied to said shaft;

an armrest frame rotatably mounted on said shaft and including stop engaging means for permitting limited rotation of said armrest frame on said shaft and for adjusting the degree of rotation of said armrest frame on said shaft.

2. The armrest assembly of claim 1 wherein said shaft includes a radially extending flange that positions said frame relative to the seat.

3. The armrest assembly of claim 1 wherein said armrest frame comprises a channel having a top and bottom and wherein said adjustable member is positioned on the bottom of the frame.

4. The armrest assembly of claim 3 wherein said adjustable member comprises a threaded stud with an actuation knob located outside said channel.

5. The armrest assembly of claim 1 wherein said seat frame is substantially rigid and wherein said shaft is assembled to said seat frame and includes a radially extending flange that abuts said seat frame to position said armrest assembly and to resist radially directed forces applied to said shaft.

6. The armrest assembly of claim 5 wherein said shaft includes a base portion having an axially extending planar surface positioned adjacent to said seat frame that provides increased stability to said armrest assembly.

7. The armrest assembly of claim 6 wherein said assembly is reversibly mountable to either the right or left side of said seat frame.

8. An adjustable armrest assembly mounted to a seat having a frame comprising:

a shaft having two ends mounted to and extending laterally from said seat, said shaft including at least one radially extending stop member and one end of said shaft having a radially extending surface and an axially extending surface abutting said seat frame;

an armrest frame rotatably mounted on said shaft and including a first stop engaging member positioned on said armrest frame to limit upward rotation of said armrest frame about said shaft, and a second stop engaging member secured to said armrest frame to limit downward rotation of said armrest frame about said shaft, at least one of said stop engaging members being adjustable to thereby adjust the degree of rotation of said frame on said shaft.

9. An adjustable armrest assembly mounted to a seat having a frame comprising:

a shaft with two ends mounted to and extending laterally from said seat, said shaft including at least one radially extending stop member and one end of the shaft having a plurality of longitudinally extending surfaces abutting said seat frame to resist radially directed forces applied to said shaft;

an armrest frame rotatably mounted on said shaft and including a first stop engaging member positioned on said armrest frame to limit upward rotation of said armrest frame about said shaft, and a second stop engaging member secured to said armrest frame to limit downward rotation of said armrest frame about said shaft, at least one of said stop engaging members being adjustable to thereby adjust the degree of rotation of said frame on said shaft.

10. An adjustable armrest assembly mounted to a seat having a frame, comprising:

a shaft having two ends mounted to and extending laterally from said seat frame, said shaft including at least one stop member and one end of the said shaft having a plurality of longitudinally extending surfaces abutting the seat frame to resist radially directed forces applied to said shaft;

an armrest frame rotatably mounted on said shaft and including stop engaging means for permitting limited rotation of said armrest frame on said shaft and for adjusting the degree of rotation of said armrest frame on said shaft.

* * * * *